United States Patent [19]

Beyer

[11] 4,235,732

[45] Nov. 25, 1980

[54] LIQUID BLEACHING COMPOSITIONS

[75] Inventor: Harold H. Beyer, Glashuetten, Fed. Rep. of Germany

[73] Assignee: The Procter & Gamble Company, Cincinnati, Ohio

[21] Appl. No.: 875,954

[22] Filed: Feb. 8, 1978

[51] Int. Cl.[2] ..... C11D 7/56; C11D 7/34

[52] U.S. Cl. ..... 252/103; 252/535

[58] Field of Search ..... 252/103, 535

[56] References Cited

U.S. PATENT DOCUMENTS

| | | | |
|---|---|---|---|
| 3,172,861 | 3/1965 | Steinhauer | 252/95 X |
| 3,560,389 | 2/1971 | Hunting | 252/99 |
| 3,758,409 | 9/1973 | Nakagawa et al. | 252/99 |
| 3,929,661 | 12/1975 | Nakagawa et al. | 252/99 |
| 4,005,027 | 1/1977 | Hartman | 252/103 |
| 4,017,409 | 4/1977 | Demessemaskers et al. | 252/535 |
| 4,051,055 | 9/1977 | Trinh et al. | 252/535 |

FOREIGN PATENT DOCUMENTS

| | | |
|---|---|---|
| 2094708 | 4/1972 | France . |

*Primary Examiner*—Mayer Weinblatt

*Attorney, Agent, or Firm*—Ronald L. Hemingway; Richard C. Witte

[57] ABSTRACT

Alkaline aqueous hypochlorite cleaning compositions containing paraffin sulfonates as bleach stable surfactants.

10 Claims, No Drawings

LIQUID BLEACHING COMPOSITIONS

BACKGROUND AND DESCRIPTION OF PRIOR ART

This invention relates to liquid detergent bleaching compositions possessing excellent storage stability. The liquid detergent bleaching composition is an alkaline aqueous solution of a compound which produces hypochlorite ions in aqueous solution, and a paraffin sulfonate surface active agent. In a preferred embodiment, the compositions of the invention have suspended therein, a particulate abrasive material, and have utility as liquid scouring cleansers.

The incorporation of hypochlorite bleach into liquid cleaning compositions, such as scouring cleansers and other types of hard surface cleaners is highly desirable because the hypochlorite is effective in promoting soil and stain removal, and is also an effective disinfectant. However, because of the powerful oxidizing power of hypochlorite bleach, its formulation into liquid cleaning products generally results in chemical instability because of reaction between the bleach and the organic surfactants which are used in such products.

U.S. Pat. No. 4,005,027 issued to Hartman Jan. 25, 1977 discloses aqueous liquid alkaline abrasive scouring compositions comprising a particulate abrasive, a suspending agent for the abrasive, an alkaline buffer salt, hypochlorite bleach and a bleach stable surfactant, alkyl sulfates and betaines being specifically exemplified.

DESCRIPTION OF THE INVENTION

In its broadest aspect the present invention comprises aqueous liquid bleaching compositions comprising from about 0.1% to about 10% of a compound which produces hypochlorite ions in aqueous media, from about 0.03% to about 10% of a paraffin sulfonate surfactant, from about 1% to about 20% of an alkaline salt capable of maintaining said composition at an alkaline pH, and from about 10% to about 90% water. The compositions can contain various optional ingredients as more fully described hereinafter. According to the present invention it has been found that the paraffin sulfonate surfactants exhibit a high degree of chemical stability in the the presence of hypochlorite, and in fact are more stable than the alkyl sulfates disclosed in U.S. Pat. No. 4,005,027. All percentages herein are be weight, unless otherwise specified.

Hypochlorite Bleach

Any of the many known compounds which produce the hypochlorite species ($OCl^-$) in alkaline aqueous solutions can be used as the hypochlorite bleach in the present compositions. (See for example U.S. Pat. No. 4,005,027, incorporated by reference herein.) Examples of such compounds include alkali metal and alkaline earth metal hypochlorites, hypochlorite addition products, chloramines, chlorimines, chloramides, and chlorimides. Specific examples of compounds of these types include sodium hypochlorite, potassium hypochlorite, calcium hypochlorite, magnesium hypochlorite, chlorinated trisodium phosphate dodecahydrate, potassium dichloroisocyanurate, sodium dichloroisocyanurate, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during preparation of the compositions of the instant invention. Some of the above materials, such as sodium hypochlorite, are available as aqueous solutions.

The compounds are present in the compositions at levels of from about 0.1% to about 10%, preferably from about 0.2% to about 5%.

Surfactant

The paraffin sulfonate surfactants, which are an essential component of the compositions herein, have the general formula $RSO_3M$, wherein R is a primary or secondary alkyl group containing from about 8 to about 22 carbon atoms (preferably 10 to 18) and M is an alkali metal, e.g., sodium or potassium. Paraffin sulfonate surfactants and methods for their preparation are well known in the art. They may be prepared, for example, by reaction of hydrocarbons with sulfur dioxide, oxygen and a sulfonation reaction initiator. Alternatively, they may be prepared by reacting an alkene and a sodium bisulfite under suitable radiation or catalysis (See British Pat. No. 1,451,228, published Sept. 29, 1976). Paraffin sulfonate surfactants are commercially available, e.g., from Farbwerke Hoechst AG.

Preferred paraffin sulfonates herein are secondary paraffin sulfonates.

Examples of specific paraffin sulfonates herein are:
Sodium-1-decane sulfonate,
Potassium-2-decane sulfonate,
Lithium-1-dodecane sulfonate,
Sodium-6-tridecane sulfonate,
Sodium-2-tetradecane sulfonate,
Sodium-1-hexadecane sulfonate,
Sodium-4-octadecane sulfonate
Sodium-3-octadecane sulfonate.
Normally, the paraffin sulfonates are available as mixtures of individual chain lengths and position isomers, and such mixtures are suitable for use herein.

In addition to excellent chemical stability in the presence of hypochlorite bleach, the paraffin sulfonates are highly effective in removing certain soils (such as greasy food stains) from hard surfaces.

The paraffin sulfonates are moderately low foaming surfactants when used alone in the compositions herein. Their foaming power can be boosted by combining them with alkyl sulfate surfactants of the formula $ROSO_3M$ wherein R is a primary alkyl group containing from about 8 to about 22 (preferably 10 to 18) carbon atoms and M is an alkali metal, e.g., sodium or potassium. Examples of alkyl sulfates are sodium lauryl sulfate, sodium myristyl sulfate, potassium hexadecyl sulfate, and sodium octadecyl sulfate, coconut alkyl sulfate and tallow alkyl sulfate.

When used in mixtures herein, the weight ratio of paraffin sulfonate to alkyl sulfate in such mixtures is from about 1:10 to about 10:1, preferably 1:2 to about 2:1. Such mixtures provide a synergistic sudsing effect, i.e., the mixtures provide higher sudsing than either surfactant alone. Even though alkyl sulfates are not as stable to hypochlorite as paraffin sulfonates, various mixtures of the two surfactants such as those within the preferred range set forth above appear to be as stable to hypochlorite as paraffin sulfonate alone.

The total surfactant level in compositions of the invention is from about 0.03% to about 10%, preferably from about 0.1% to about 5%, regardless of whether paraffin sulfonate or a mixture of paraffin sulfonate and alkyl sulfate is used.

Alkaline Buffer Salt

From about 1% to about 20% be weight, preferably from about 2% to 15% by weight, of the present compositions comprises an inorganic alkaline salt capable of maintaining an alkaline pH in the composition. Preferably the type and amount of alkaline salt is chosen so as to keep the composition pH within the range of from about 10.0 to 14; preferably from about 10.5 to 13. Maintenance of composition pH at above about 10.0 is an important factor in the maximization of the unique chemical stability of the instant compositions and additionally serves to enhance the cleaning performance of the compositions.

Maintenance of the composition pH within the 10.0 to 14 range helps to minimize chemical decomposition of the hypochlorite-yielding bleaching agents in aqueous media. Maintenance of this pH range also minimizes any chemical interaction between the hypochlorite compound and the paraffin sulfonate surfactant compounds present in the instant compositions. Finally, high pH values serve to enhance the soil and stain removal properties of the surfactant during utilization of the present compositions.

Any bleach-stable salt or mixture of salts which has the effect of providing the composition with an alkaline pH and maintaining it there can be utilized as the alkaline salt in the instant invention (see for example U.S. Pat. No. 4,005,027). Such materials can include, for example, various water-soluble (i.e., soluble in water to the extent of at least 1% by weight at room temperature), inorganic salts such as the alkali metal (e.g., sodium or potassium) carbonates, bicarbonates, sesquicarbonates, silicates, pyrophosphates, phosphates, tetraborates, and mixtures thereof. Specific examples of materials which can be used either alone or in combination as the alkaline salt herein include potassium carbonate, sodium bicarbonate, sodium sesquicarbonate, sodium silicate, tetrapotassium pyrophosphate, trisodium phosphate, anhydrous sodium tetraborate, sodium tetraborate pentahydrate, sodium tetraborate decahydrate, and mixtures of these salts. Preferred alkaline salts for use herein include mixtures of tetrapotassium pyrophosphates and tripotassium phosphate in a pyrophosphate/-phosphate salt weight ratio of about 2:1 and mixtures of anhydrous potassium carbonate and sodium bicarbonate in a carbonate/bicarbonate salt weight ratio of about 50:1. Transition metal salts should generally be avoided, since many of these tend to decompose hypochlorite ions in aqueous media. Generally, the alkali metal salts are preferred.

It is highly preferred in compositions of the instant invention to include a material which acts as a detergent builder, i.e., a material which reduces the free calcium and/or magnesium ion concentration in a surfactant-containing aqueous solution. Some of the above-described alkaline materials additionally serve as builder materials. Such compounds as the carbonates, phosphates and pyrophosphates are of this type. Other alkaline materials such as tetraborates perform no building function, although they are still useful herein for the alkaline pH which they provide.

Since presence of a builder in the instant compositions is highly desirable, it is preferred that the essential alkaline salt component of the compositions contains at least one compound capable of acting as a builder, i.e., capable of lowering the free calcium and/or magnesium ion content of an aqueous solution such as is formed by diluting compositions of the present invention with tap water.

Water

From about 10% to about 90% by weight, preferably from about 50% to 85% by weight, of the instant composition comprises water. Water is the medium which serves to dissolve the soluble components of the instant invention, for example, the bleach, surfactant, buffering agent and various optional materials. Since it is well known that many transition metals can react with and deactivate the bleaching agents of the present invention, such metals should preferably not be present in the water used to prepare the compositions of the invention. Preferably, the water used to prepare the compositions of the invention should be "soft" or deionized water.

Liquid Scouring Compositions

Preferred compositions of the present invention are liquid scouring cleansers which contain, in addition to the essential ingredients listed hereinbefore, a particulate insoluble abrasive and a suspending agent which serves to keep the abrasive suspended in the composition. Such compositions are described in detail in U.S. Pat. Nos. 4,005,027, issued Jan. 25, 1977, 3,985,668, issued Oct. 12, 1976, and 4,051,056, issued Sept. 27, 1977, all issued to Hartman and all being incorporated by reference herein.

The insoluble particulate abrasive material comprises from about 5% to about 60%, preferably from about 8% to about 32% of the liquid scouring composition. Such insoluble materials have particle size diameters ranging from about 1 to about 250 microns and specific gravities of from about 0.2 to about 5.0. It is preferred that the diameter of the particles range from about 2 microns to about 190 microns and that their specific gravity range from about 0.3 to about 2.8, most preferably from about 0.4 to 2.4. Insoluble abrasive particulate material of this size and specific gravity can be suspended in the false-body scouring compositions of the type disclosed in the aforedescribed patents issued to Hartman. "Specific gravity" for purposes of the instant invention has its conventional definition, i.e., the weight of abrasive material per cubic centimeter of water displaced by such material.

The abrasives which can be utilized include, but are not limited to, quartz, pumice, pumicite, titanium dioxide ($TiO_2$), silica sand, calcium carbonate, zirconium silicate, diatomaceous earth, whiting, feldspar and expanded perlite. Expanded perlite is the preferred abrasive for these liquid compositions. A detailed discussion of expanded perlite and its use in liquid scouring compositions is given in U.S. Pat. No. 4,051,056, supra.

Suspending Agent

The suspending agents for use in the abrasive-containing compositions herein are the inorganic colloid-forming clays selected from the group consisting of smectites, attapulgites and mixtures of smectites and attapulgites. Smectites are preferred. The clay combines with the free water of the liquid compositions of the present invention to form fluid compositions which are false-bodied in nature.

"False-body" fluids are related to but are not identical to fluids having thixotropic properties. True thixotropic materials break down completely under the influence of high stresses and behave like true liquids even after the stress has been removed, until such time as the structure is reformed. False-bodied materials, on the other hand, do not, after stress removal, lose their solid properties entirely and can still exhibit a yield value even though it might be diminished. The original yield value is regained only after such fluids are at rest for considerable lengths of time. (See Non-Newtonian Fluids, Wilkinson, Permagon Press (1960).)

The instant preferred false-body liquid compositions in a quiescent state are highly viscous, are Bingham plastic in nature, and have relatively high yield values. When subjected to shear stresses, however, such as being shaken in a bottle or squeezed through an orifice, these preferred compositions fluidize and can be easily dispensed. When the shear stress is stopped, the compositions quickly revert to a high viscosity/Bingham plastic state.

The aforementioned types of clays and their use in formulating false-body fluid scouring cleansers are more fully described in U.S. Pat. No. 4,005,027, supra, incorporated herein by reference.

The clay suspending agent is generally present in the liquid compositions of the instant invention to the extent of from about 1% to 30% by weight, preferably from about 2% to 5% by weight, of the total composition.

Miscellaneous Optional Materials

In addition to the aforedescribed materials which comprise compositions of the instant invention, such compositions can optionally also contain various other materials to enhance their performance, stability, or aesthetic appeal. Such materials include optional nonbuffering builder compounds, coloring agents and perfumes. Although, as noted above, some of the above-described alkaline salts do function as builder compounds, it is possible to add other bleach-stable builder compounds which are not, in themselves, alkaline salts. Typical of these optional builder compounds which do not necessarily buffer within the required pH range are certain zeolites (See U.S. Pat. No. 3,985,669, Krummel et al., issued Oct. 12, 1976, incorporated herein by reference).

Conventional coloring agents and perfumes can also be added to the instant compositions to enhance their aesthetic appeal and/or consumer acceptability. These materials should, of course, be those dye and perfume varieties which are especially stable against degradation by strong active chlorine bleaching agents.

If present, the above-described optional materials generally comprise no more than about 5% by weight of the total composition.

Composition Preparation

The liquid compositions of the instant invention can be prepared by admixing the above-described essential and optional components together in the appropriate concentrations by conventional means normally used to form the requisite compositions. Some shear agitation is generally necessary to insure proper preparation of such compositions when they contain an abrasive and suspending agent. The extent of shear agitation, in fact, can be used to vary, as desired, the nature of the liquid abrasive compositions so prepared.

A particularly preferred procedure for preparing false-body liquid abrasive compositions is described in Example II of this specification.

Composition Use

The liquid compositions of the present invention can be used in a wide variety of cleaning and scouring operations where bleaching and/or disinfecting performance is required. For example, the nonabrasive compositions herein find use in cleaning and disinfecting of tableware for restaurants and institutions, bleaching of textiles and cleaning of restroom floors and animal cages. The abrasive compositions find use in the scouring of sinks, bathtubs and various other hard surfaces wherein soil accumulates which is difficult to remove by ordinary detersive processes.

The present invention will be illustrated by the following examples.

Example I

A liquid cleaning and disinfecting composition is prepared having the following formula:

| Component | Wt. % |
|---|---|
| Sodium hypochlorite | 2% |
| Na paraffin sulfonate | 2 |
| Sodium carbonate | 3 |
| Deionized water | 93 |
| | 100% |

The composition is prepared by mixing 382 parts of a 5.25% solution of sodium hypochlorite in deionized water with 20 parts of paraffin sulfonate, 30 parts of sodium carbonate and 568 parts of deionized water. This composition has excellent chemical stability in storage and provides excellent cleaning and disinfecting performance.

Example II

A false-body, hard surface abrasive cleanser of the following composition is prepared:

| Component | Wt. % |
|---|---|
| Gelwhite GP Clay[1] | 2.6 |
| Tetrapotassium pyrophosphate | 5.8 |
| Tripotassium orthophosphate | 2.6 |
| Sodium hypochlorite bleach | 0.9 |
| Sodium secondary paraffin sulfonate[2] | 1.5 |
| Expanded perlite abrasive[3] (Particle size range- 10 to 190 microns, specific gravity 1.45 g/cc. | 8.0 |
| Pigment | 92 ppm |
| Perfume | 0.25 |
| Deionized water | Balance |
| | 100.00% |
| Composition pH=11.5 | |

[1]A smectite clay from Southern Clay Co.
[2]Hostaspur SAS 60 from Farbwerke Hoechst AG
[3]From Silbrico Co.

The above described Example II composition is prepared in the following manner. The clay and about 75% of the total amount of water used in the formula are mixed together and passed seven times through an in-line high shear mixer to form a uniform aqueous dispersion of the clay. The perlite abrasive is then added. Then the pyrophosphate is mixed slowly into this dispersion to form a false-body fluid. The remaining ingredients are then added (with mixing) in the order: tripotassium phosphate, pigment, perfume, paraffin sulfonate and sodium hypochlorite. The remainder of the water is then added to make up 100 parts of finished composition, and the composition is passed through a vacuum deaerator to remove entrapped air.

The resulting scouring composition is false-bodied, i.e., gel-like in its quiescent state but easily fluidized by application of shear stress. In its quiescent state, the composition maintains the perlite abrasive in a uniformly suspended dispersion. When applied to horizontal or vertical hard surfaces, the composition is not fluid and does not appreciably run along such surfaces.

Such a composition exhibits negligible clear layer separation and has excellent bleach and surfactant stability in storage. This composition, used in undiluted form, is effective for removal of stains and soil from hard surfaces and in sanitizing the surfaces.

What is claimed is:

1. An aqueous false-body hard-surface scouring cleanser consisting essentially of;

A. from about 0.2% to 5% by weight of a bleaching agent which yields hypochlorite ion in aqueous solution.

B. from about 1% to 30% by weight of an inorganic colloid-forming clay selected from the group consisting of smectites, attapulgites and mixtures of smectite and attapulgites;

C. from about 0.1% to 5% by weight of a paraffin sulfonate surfactant of the formula $RSO_3M$ wherein R is a primary or secondary alkyl group containing from about 8 to about 22 carbon atoms and M is an alkali metal;

D. from about 5% to 60% by weight of insoluble particulate abrasive material which has particle diameters ranging from one micron to about 250 microns and a specific gravity of from about 0.2 to about 5.0;

E. from about 2% to 15% by weight of an inorganic alkaline buffer salt capable of maintaining composition pH within the range of from about 10.0 to 14; and F. from about 10% to 90% by weight of water.

2. The composition of claim 1, wherein the bleaching agent which produces hypochlorite ion is sodium hypochlorite and is present at a level of from about 0.2% to about 5%, wherein the amount of water in the composition is from about 50% to about 85%, and wherein the amount of abrasive in the composition is from about 8% to about 32%.

3. The composition of claim 2, wherein the inorganic colloid-forming clay is a smectite clay and is present at a level of from about 2% to about 5% of the composition.

4. The composition of claim 3 wherein the paraffin sulfonate surfactant is a $C_{10}$ to $C_{18}$ paraffin sulfonate.

5. The composition of claim 4, wherein the inorganic alkaline buffer salt is selected from the group consisting of alkali metal carbonates, bicarbonates, sesquicarbonates, silicates, pyrophosphates, phosphates, tetraborates and mixtures thereof.

6. The composition of claim 5, wherein the insoluble particulate abrasive is selected from the group consisting of quartz, pumice, pumicite, titanium dioxide, silica sand, calcium carbonate, zirconium silicate, diatomaceous earth, whiting, feldspar, and expanded perlite.

7. The composition of claim 6, wherein the insoluble particulate abrasive has a specific gravity of from about 0.4 to about 2.4.

8. The composition of claim 7 wherein the particulate abrasive is expanded perlite.

9. The composition of claim 4, containing as an additional surfactant a $C_8$ to $C_{22}$ alkyl sulfate, wherein the ratio of paraffin sulfonate to alkyl sulfate is from 10:1 to about 1:10, and wherein the total surfactant level in the composition is from about 0.1% to about 5%.

10. The composition of claim 9, wherein the alkyl sulfate is a $C_{10}$ to $C_{18}$ alkyl sulfate and wherein the ratio of paraffin sulfonate to alkyl sulfate is from about 1:2 to about 2:1.

* * * * *